US009168189B2

(12) United States Patent
Ziaylek et al.

(10) Patent No.: US 9,168,189 B2
(45) Date of Patent: Oct. 27, 2015

(54) TANK RETAINING BRACKET

(71) Applicants: Michael P. Ziaylek, Yardley, PA (US); W. Brian McGinty, Huntingdon Valley, PA (US)

(72) Inventors: Michael P. Ziaylek, Yardley, PA (US); W. Brian McGinty, Huntingdon Valley, PA (US)

(73) Assignee: Michael P. Ziaylek, Yardley, PA (US)

( * ) Notice: Subject to any disclaimer, the term of this patent is extended or adjusted under 35 U.S.C. 154(b) by 0 days.

(21) Appl. No.: 13/999,346

(22) Filed: Feb. 11, 2014

(65) Prior Publication Data

US 2014/0263380 A1 Sep. 18, 2014

Related U.S. Application Data

(60) Provisional application No. 61/852,374, filed on Mar. 15, 2013.

(51) Int. Cl.

| | |
|---|---|
| ***A47K 1/08*** | (2006.01) |
| ***A61G 1/04*** | (2006.01) |
| ***A62B 25/00*** | (2006.01) |

(52) U.S. Cl.
CPC .. *A61G 1/04* (2013.01); *A62B 25/00* (2013.01)

(58) Field of Classification Search
USPC ..... 248/311.2, 313, 671, 230.5, 312; 220/737; 137/343, 376; 224/434, 441
See application file for complete search history.

(56) References Cited

U.S. PATENT DOCUMENTS

| | | | | |
|---|---|---|---|---|
| 1,546,576 | A | 7/1925 | Erwin et al. | |
| 2,499,672 | A * | 3/1950 | Nurkiewicz | 248/313 |
| 3,304,116 | A | 2/1967 | Stryker | |
| 3,761,968 | A | 10/1973 | Besler | |
| 3,817,435 | A | 6/1974 | DeLuca et al. | |
| 3,857,598 | A | 12/1974 | Jelich | |
| 4,013,255 | A * | 3/1977 | Sentinella | 248/313 |
| 4,045,044 | A | 8/1977 | Bierer | |
| 4,073,317 | A | 2/1978 | Ellis | |
| 4,213,648 | A | 7/1980 | Steichen | |
| 4,383,528 | A | 5/1983 | Eppolito | |
| 4,606,521 | A | 8/1986 | Williams | |
| 4,768,241 | A | 9/1988 | Beney | |
| D319,778 | S * | 9/1991 | Ziaylek, Jr. | D8/373 |
| 5,060,832 | A * | 10/1991 | Link | 224/414 |
| 5,170,981 | A * | 12/1992 | Lin | 248/311.2 |
| 5,259,372 | A | 11/1993 | Gross et al. | |
| D357,217 | S | 4/1995 | Shirley | |
| D393,795 | S | 4/1998 | Bernstein | |
| 6,220,557 | B1 | 4/2001 | Ziaylek et al. | |
| 6,390,427 | B1 * | 5/2002 | McConnell et al. | 248/231.61 |
| 6,543,736 | B2 | 4/2003 | Field | |
| 6,830,226 | B2 | 12/2004 | Field et al. | |
| D528,904 | S | 9/2006 | Reding | |
| 7,188,855 | B1 | 3/2007 | Thomas | |
| 7,370,660 | B2 | 5/2008 | Hamilton et al. | |

(Continued)

*Primary Examiner* — Terrell McKinnon
*Assistant Examiner* — Michael McDuffie
(74) *Attorney, Agent, or Firm* — Fox Rothschild LLP

(57) ABSTRACT

The gas tank retaining device of the present invention is particularly usable for retaining oxygen cylinders with respect to emergency equipment such as mobile stretchers that need to be transported in vehicles. Security of heavy oxygen or gas tanks is achieved by providing a housing with an access opening and a uniquely configured locking mechanism for retaining a generally cylindrical tank preferably in a horizontal orientation. The locking mechanism is steady state biased in a closed or retaining position for holding the tank within the housing and can be moved to a releasing position responsive to manual manipulation thereof.

20 Claims, 12 Drawing Sheets

(56) References Cited

U.S. PATENT DOCUMENTS

| | | | | |
|---|---|---|---|---|
| 7,373,947 | B2 | 5/2008 | Trettin et al. | |
| 7,448,586 | B2 | 11/2008 | Ziaylek et al. | |
| 7,650,948 | B2 * | 1/2010 | Rousseau et al. | 169/51 |
| D618,356 | S | 6/2010 | Ross | |
| D620,783 | S | 8/2010 | Ziaylek | |
| 7,865,984 | B2 | 1/2011 | Merritt | |
| 8,100,307 | B2 | 1/2012 | Chinn et al. | |
| 8,220,764 | B2 | 7/2012 | Ziaylek | |
| 2002/0104934 | A1 * | 8/2002 | Elliott et al. | 248/126 |
| 2003/0094556 | A1 * | 5/2003 | Meggiolan | 248/311.2 |
| 2006/0086876 | A1 * | 4/2006 | Heerdt et al. | 248/311.2 |
| 2006/0284040 | A1 * | 12/2006 | Nixon et al. | 248/311.2 |
| 2008/0190947 | A1 | 8/2008 | Bourgraf | |
| 2009/0184147 | A1 * | 7/2009 | Wen | 224/461 |
| 2009/0250582 | A1 * | 10/2009 | Ziaylek | 248/312 |
| 2010/0219220 | A1 * | 9/2010 | Bostrom et al. | 224/547 |
| 2012/0286120 | A1 * | 11/2012 | Ziaylek et al. | 248/312 |

* cited by examiner

TANK RETAINING BRACKET

The present utility application hereby formally claims priority of currently U.S. Provisional Patent application No. 61/852,374 filed Mar. 15, 2013 on a "Gas Tank Retaining Means" which identifies the same inventors as listed herein, namely, Michael P Ziaylek and W Brian McGinty, and assigned to the same assignee as listing herein, namely, Michael P Ziaylek: said referenced provisional application being hereby formally incorporated by reference as an integral part of the present application.

BACKGROUND OF THE INVENTION

1. Field of the Invention

The present invention relates to the field of brackets specifically designed to be utilized for holding canisters or tanks usually containing gas, particularly used mounted with respect to an emergency mobile transporting device, such as a stretcher or gurney. Often such canisters are needed to continuously make available a supply of oxygen to patients when being transported on a stretcher or gurney. The mechanism of the present invention is designed specifically for facilitating holding of such generally cylindrical tanks in a horizontal orientation or vertical orientation by defining a partially closed housing into which the canister can conveniently be slid easily and conveniently. Such devices are commonly retained in a horizontal orientation. A uniquely configured locking mechanism is included for use therewith which retains such a canister securely and conveniently within the bracket configuration.

2. Description of the Prior Art

Many devices have been patented for the purposes of retaining oxygen tanks especially with respect to health transport equipment such as gurneys and/or wheelchairs such as shown in U.S. Pat. No. 1,546,576 patented Jul. 21, 1925 to O. R. Erwin et al and assigned to O. R. Erwin, John J. Hannan, Herman L. Ekren and Thomas F. Frawley on a "Fire Extinguishing Device; and U.S. Pat. No. 3,304,116 patented Feb. 14, 1967 to H. H. Stryker and assigned to Stryker Corporation on a "Mechanical Device"; and U.S. Pat. No. 3,761,968 patented Oct. 2, 1973 to Herbert C. Besler on an "Oxygen Bottle Carrier Particularly For Stretchers"; and U.S. Pat. No. 3,817,435 patented Jun. 18, 1974 to Anthony F. De Luca et al on a "Tank Holder And Transporter"; and U.S. Pat. No. 3,857,598 patented Dec. 31, 1974 to George W. Jelich on a "Hot Tube Handling Device"; and U.S. Pat. No. 4,045,044 patented Aug. 30, 1977 to William F. Bierer on a "Patient Transport With Oxygen Supply"; and U.S. Pat. No. 4,073,317 patented Feb. 14, 1978 to James B. Ellis and assigned to Fibreboard Corporation on an "Adjustable Clamping Device"; and U.S. Pat. No. 4,213,648 patented Jul. 22, 1080 to Clemons P. Steichen on an "Oxygen Tank Holding Device For Wheelchairs"; and U.S. Pat. No. 4,383,528 patented May 17, 1983 to Salvatore Eppolito on an "Oxygen Caddy" and U.S. Pat. No. 4,606,521 patented Aug. 19, 1986 to Gary R. Williams on a "Cylinder Holder"; and U.S. Pat. No. 4,768,241 patented Sep. 6, 1988 to Daniel R. Beney on a "Self Contained, Mobile Intensive Care Bed Structure"; and U.S. Design Pat. No. 319,778 patented Sep. 10, 1991 to Theodore Ziaylek, Jr. on a "Vertical Support Brace Bracket Panel For Holding Tubular Objects"; and U.S. Pat. No. 5,259,372 patented Nov. 9, 1993 to Betty J. Gross et al on an "Oxygen Cylinder Carrier Apparatus Particularly For Stretchers"; and U.S. Design Pat. No. 357,217 patented Apr. 11, 1995 to Terry L. Shirley on an "Oxygen Cylinder Bracket"; and U.S. Design Pat. No. 393,795 patented Apr. 28, 1998 to Patrik L. T. Bernstein and assigned to Spotlight Enterprises Incorporated on a "Fastening and Hanging Bracket"; and U.S. Pat. No. 6,220,557 patented Apr. 24, 2001 to Michael P. Ziaylek et al and assigned to Michael P. Ziaylek, Theodore Ziaylek, Jr. and Theodore P. Ziaylek on a "Mounting Bracket Means For Detachably Supporting A Generally Cylindrically-Shaped Member Upon A Wall Surface"; and U.S. Pat. No. 6,543,736 patented Apr. 8, 2003 to Bradley J. Field and assigned to Pacific Safety Products Inc. on a "Quick Release Supporting Apparatus For A Canister"; and U.S. Pat. No. 6,830,226 patented Dec. 14, 2004 to Bradley J. Field et al and assigned to Pacific Safety Products, Inc. on a "Quick Release Supporting Apparatus For A Canister"; and U.S. Design Pat. No. D528,904 patented Sep. 26, 2006 to Anthony C. Reding on a "Oxygen Tank Holder"; and U.S. Pat. No. 7,188,855 patented Mar. 13, 2007 to E. Trevor Thomas on an "Articulating Oxygen Tank Holder"; and U.S. Pat. No. 7,370,660 patented May 13, 2008 to Roger H. Hamilton et al on an "Oxygen Bottle Carrier Appliance"; and U.S. Pat. No. 7,373,947 patented May 20, 2008 to David J. Trettin et al and assigned to Irwin Industrial Tool Company on a "Storage System And Protective Device For Tanks"; and U.S. Pat. No. 7,448,586 patented Nov. 11, 2008 to Michael P. Ziaylek et al on a "Positively Engaging Apparatus For Releasably Retaining Of A Cylindrical Tank In An Inverted Vertical Position"; and U.S. Design Pat. No. D618,356 patented Jun. 22, 2010 to Christopher G. Ross and assigned to Nellcor Puritan Bennett LLC on a "Tank Holder"; and U.S. Design Pat. No. D620,783 patented Aug. 3, 2010 to Michael P. Ziaylek on an "Externally Activated Mounting Bracket"; and U.S. Pat. No. 7,865,984 patented Jan. 11, 2011 to Justen Harlow Merritt and assigned to Pedigo Products, Inc. on a "Safe Store Oxygen Bottle Holder"; and U.S. Pat. No. 8,100,307 patented Jan. 24, 2012 to Bob Chinn et al and assigned to Ferno-Washington, Inc. on an "Oxygen Bottle Carrier For Use With X-Frame Ambulance Cots"; and U.S. Pat. No. 8,220,764 patented Jul. 17, 2012 to Michael P. Ziaylek on an "Externally Activated Locking Mounting Bracket Apparatus For Holding A Tank In A Verticle Seatback"; and United States Patent Application Publication No. 2008/0190947 published Aug. 14, 2008 to Elroy E. Bourgraf on a "Portable Oxygen Bottle Holder".

SUMMARY OF THE INVENTION

The present invention provides a tank retaining bracket usable to receive and retain a cylindrical tank or other shaped tank therewithin which includes a housing having a plurality of housing walls defining an interior chamber therebetween within the housing to selectively receive and retain a cylindrical tank therewithin. A first housing end is defined in the housing which has an access opening therein in full fluid flow communication with respect to the interior chamber and which is adapted to allow a cylindrical tank to pass therethrough to facilitate entry and exit thereof with respect to the interior chamber. The housing walls will define a locking opening therein to facilitate locking of a cylindrical tank when retained within the interior chamber means. A second housing end is defined spatially disposed from the first housing end. An end wall is positioned extending over the housing end to facilitate abutment thereof with respect to a cylindrical tank when positioned retained within the interior chamber means. A locking mechanism is included having a unique configuration. Such locking mechanism is attached to the housing walls of the housing at a position immediately adjacent and extending through the locking opening defined in the housing walls. The locking mechanism includes a locking frame secured to the housing walls of the housing at a position adjacent to and extending around the locking opening defined in the housing walls. The housing frame defines a locking frame aperture positioned in registration with the locking opening and in full fluid flow communication with respect thereto and with respect to the interior chamber means. A first locking ear is included extending outwardly from the locking frame at a position immediately adjacent to the locking frame aperture defined therein. The first locking ear will define a first locking ear aperture extending therethrough. A second locking ear is included extending outwardly from the locking frame at a position immediately adjacent the locking frame aperture defined therein. This second locking ear is spatially disposed from the position of the first locking ear. The second locking ear will define a second locking ear aperture extending therethrough which is in registration with respect to the first locking ear aperture but is spatially disposed therefrom.

A pivotal axle is included pivotally extending through the first locking ear aperture and a second locking ear aperture which extends over the locking frame aperture. A pivot member is included defining a pivot channel means extending therethrough which is in aligning registration with respect to the first locking ear aperture and the second locking ear aperture to be adapted to receive the pivotal axle positioned extending therethrough responsive to positioning simultaneously through the first locking ear aperture and the second locking ear aperture. The pivot member also will define a pivot member slot defined therein in full fluid flow communication with respect to the pivot channel means. The pivot member is preferably pivotally movable about the pivot axle between a locked position extending into the interior chamber means and an unlocked position removed therefrom. This pivot member will preferably include a pivot member protruding section which is movable through the locking frame aperture extending into the interior chamber means for locking a tank in the interior chamber means responsive to movement of the pivot member to the locked position. It is also pivotally movable to a position removed from the interior chamber means responsive to movement of the pivotal member to the unlocked position to facilitate movement of the tank through the access opening for placement and removal with respect to the interior chamber means.

A resilient biasing means such a coil spring or the like may be positioned within the pivot member slot at a position extending around the pivot axle to exert force between the housing and the pivot member for continuously urging the pivot member to move toward the locked position thereof. A handle is also included preferably in the form of a lanyard which is attached to the pivot member to facilitate manual movement thereof toward the unlocked position by overcoming the force exerted by the resilient biasing means urging the pivot member toward the locked position.

It is an object of the present invention to provide tank retaining bracket usable with a stretcher or gurney for providing vital gases to patients transported therein such as to supply oxygen, etc.

It is an object of the present invention to provide a tank retaining bracket usable with a stretcher or gurney to provide a secure mounting means for selectively retaining a generally cylindrically shaped gas cylinder in a horizontal orientation.

It is an object of the present invention to provide a tank retaining bracket usable with a stretcher or gurney to provide a locking mechanism which is biased in a steady state thereof into an engaged or locking position for retaining a tank or canister within the interior chamber of a housing selectively.

It is an object of the present invention to provide a tank retaining bracket usable, particularly with gas tanks and also usable with a stretcher or gurney to provide a locking mechanism which can be easily moved from the steady state locking position to a retracted or position for removable of the tank from the housing by quick and convenient mechanical manipulation thereof.

It is an object of the present invention to provide a tank retaining bracket usable with a stretcher or gurney to provide a means for holding various different configurations and types of tanks which can also hold various different kinds of gas.

It is an object of the present invention to provide a tank retaining bracket usable with a stretcher or gurney which can be attached to various structural components of emergency equipment such a stretcher or gurney for secure mounting thereof.

It is an object of the present invention to provide a tank retaining bracket usable with a stretcher or gurney to provide a means for holding of tanks with respect to stretchers or gurneys while such emergency equipment is being transported within vehicles from one location to another.

It is an object of the present invention to provide a tank retaining bracket usable with a stretcher or gurney to provide a construction which has a minimum number of moving parts in a device which is operative to meet all healthcare safety and security requirements.

BRIEF DESCRIPTION OF THE DRAWINGS

While the invention is particularly pointed out and distinctly described herein, a preferred embodiment is set forth in the following detailed description which may be best understood when read in connection with the accompanying drawings, in which.

DETAILED DESCRIPTION OF THE PREFERRED EMBODIMENT

Figure 1:
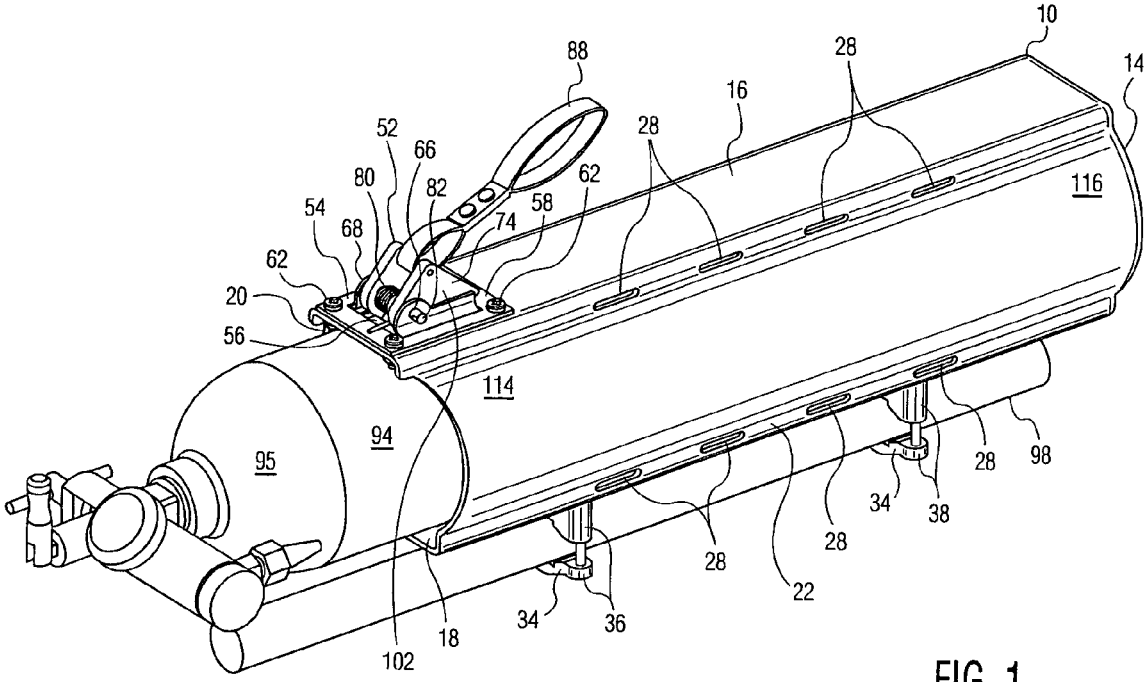
FIG. 1 is a three-quarter front perspective of an embodiment of a tank retaining bracket shown with the tank positioned partially loaded therein.
Figure 2:
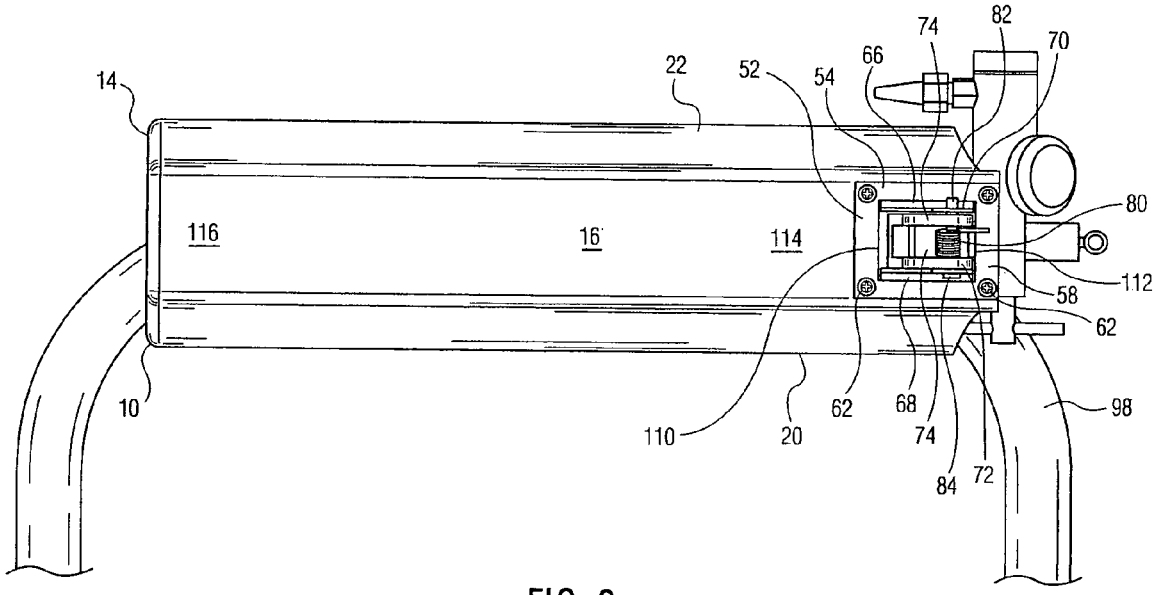
FIG. 2 is a top plan view of the embodiment for a tank retaining bracket shown in FIG. 1 with the tank locked in place within the housing.
Figure 3:
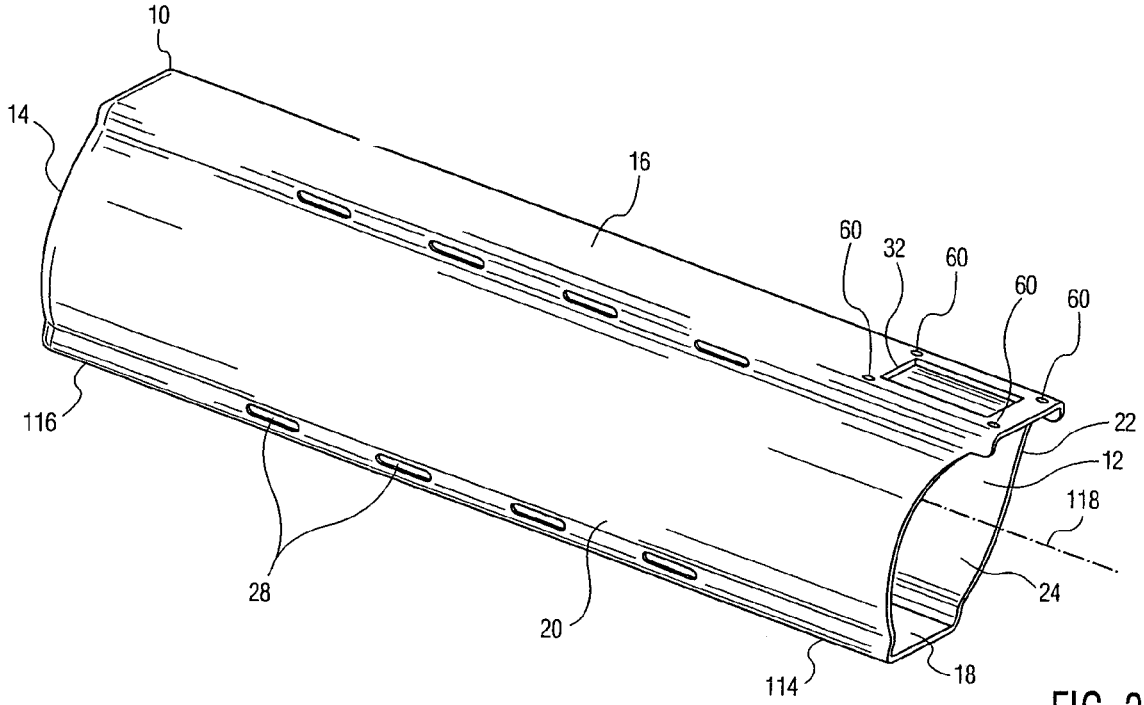
FIG. 3 is a side perspective view of an embodiment of the housing of a tank retaining bracket of the present invention showing the first, second, third and fourth housing wall along with the end panel and the access opening clearly shown.
Figure 4:
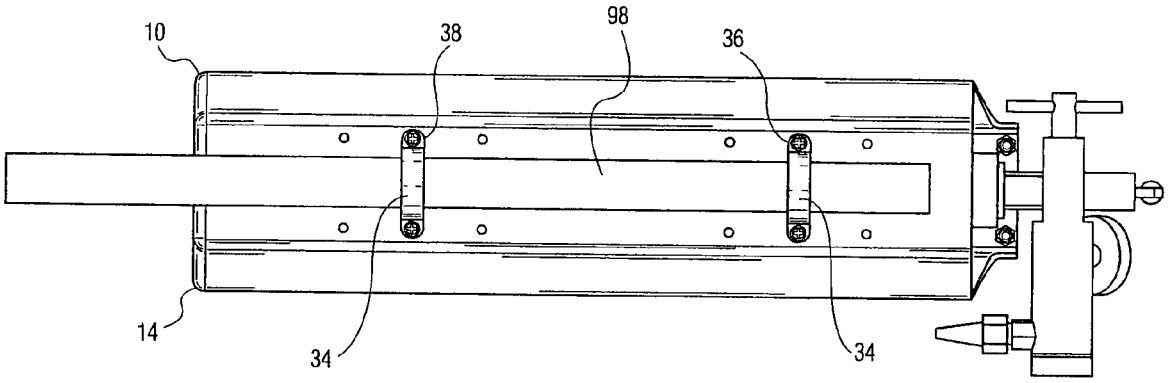
FIG. 4 is a bottom plan view of an embodiment of the tank retaining bracket of the present invention shown with the mounting brackets thereof engaged with respect to a portion of the structure of a stretcher or gurney.
Figure 5:
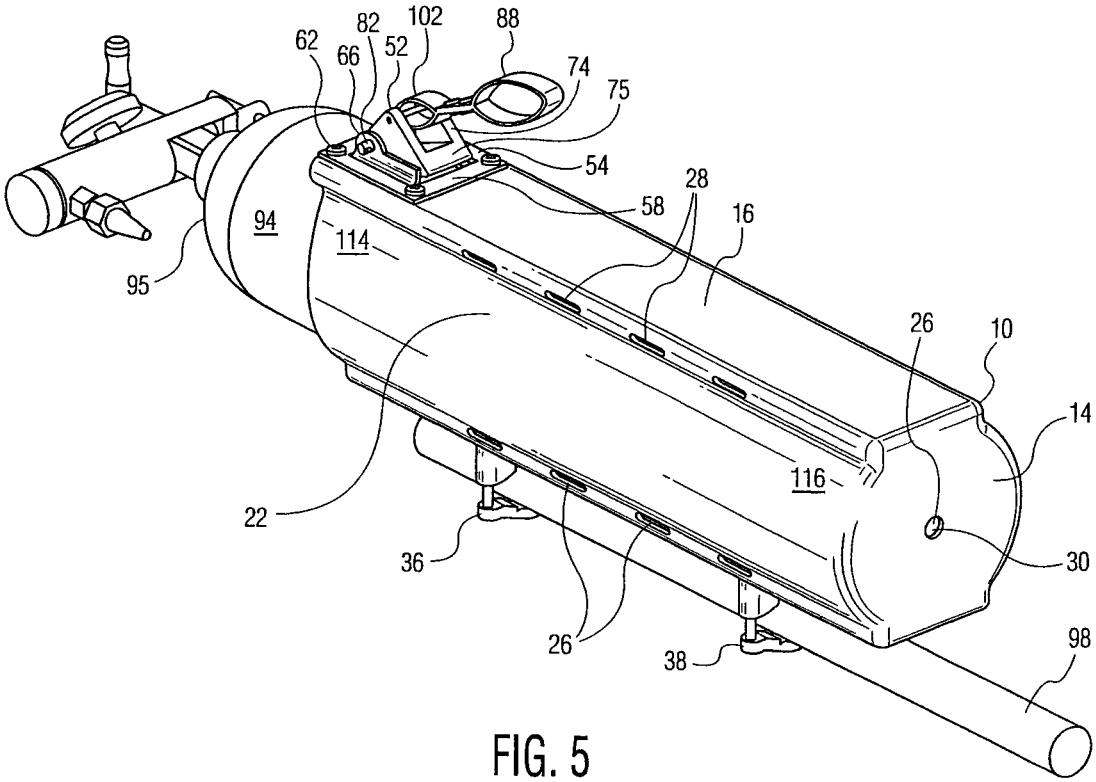
FIG. 5 is a rear three-quarter perspective view showing an embodiment of the tank retaining bracket of the present invention with the tank partially inserted within the interior chamber means of the housing while attached to a portion of the support construction for a stretcher.
Figure 6:
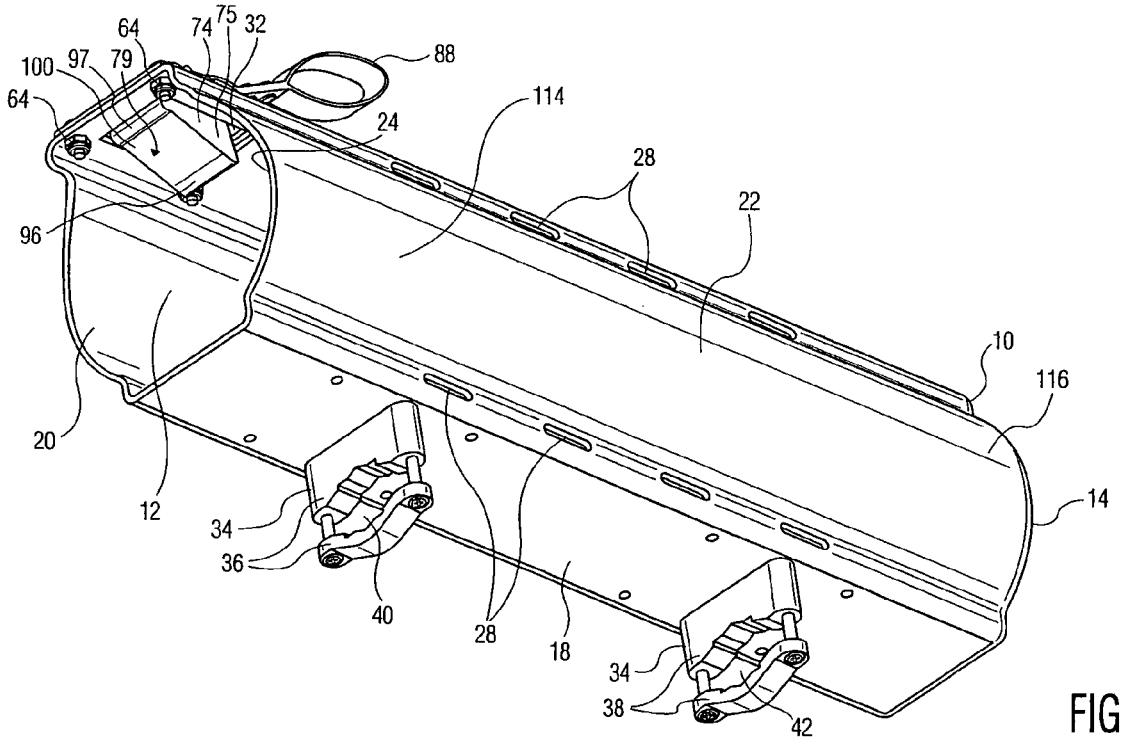
FIG. 6 is a lower three-quarter perspective view of an embodiment of the tank retaining bracket of the present invention shown with the locking mechanism in the steady state locked position.
Figure 7:
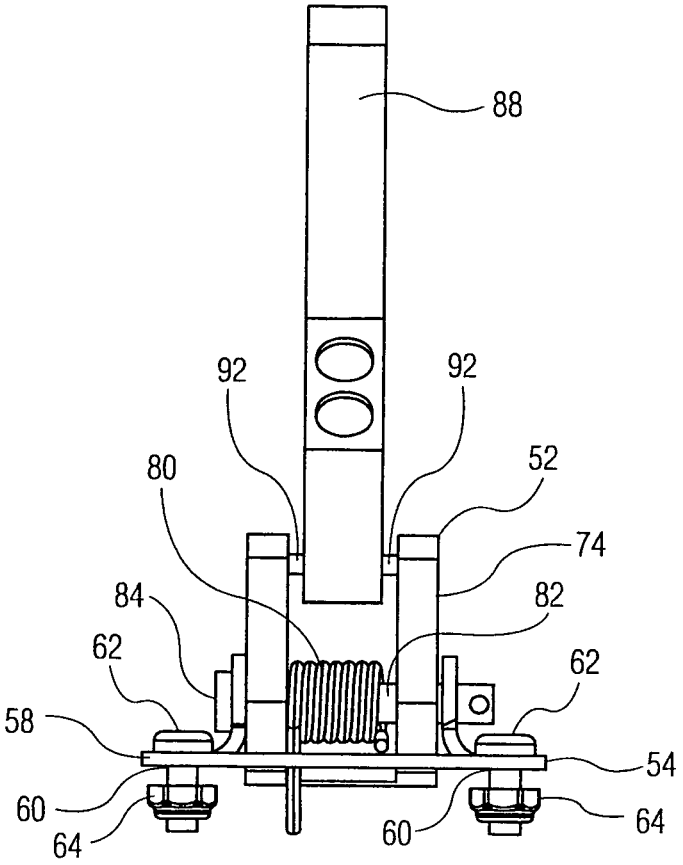
FIG. 7 is a front plan view of an embodiment of the locking mechanism of an embodiment of the gas tank bracket of the present invention.
Figure 8:
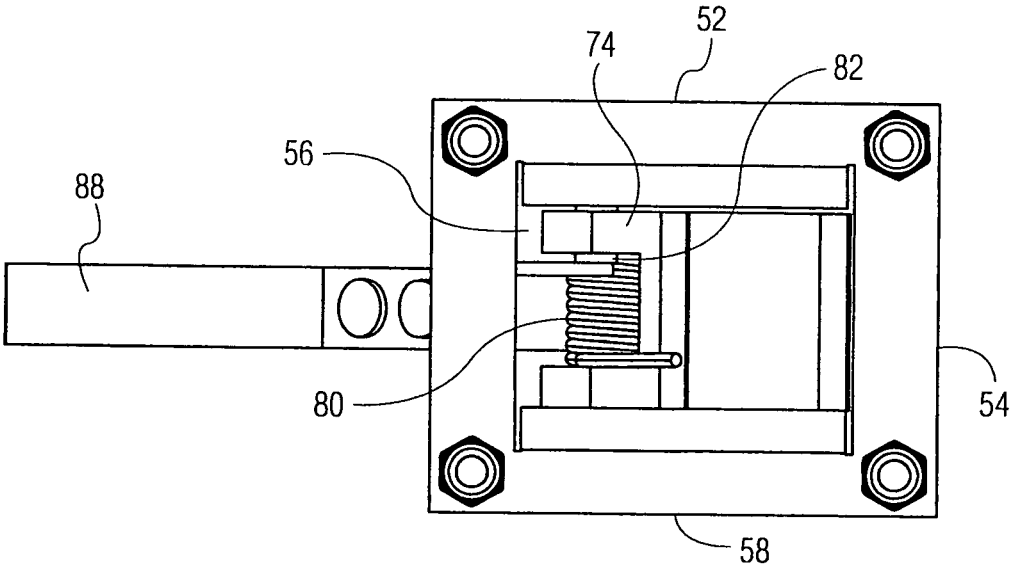
FIG. 8 is a bottom plan view of the embodiment of the tank retaining bracket as shown in FIG. 7.
Figure 9:
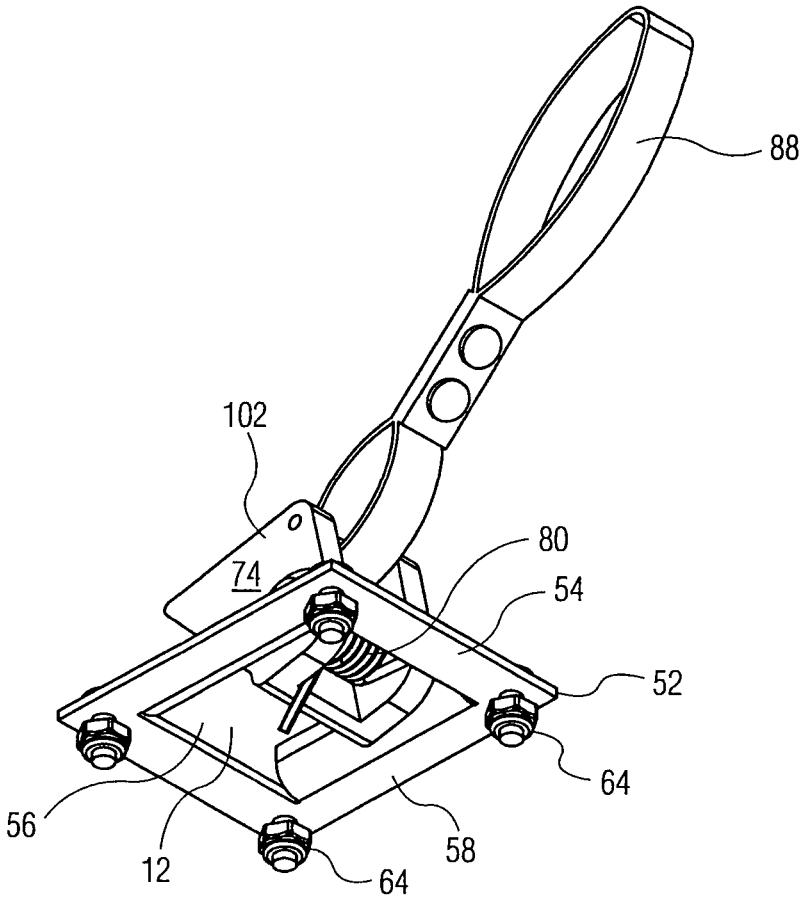
FIG. 9 is a lower three-quarter perspective view of the embodiment shown in FIG. 7.
Figure 10:
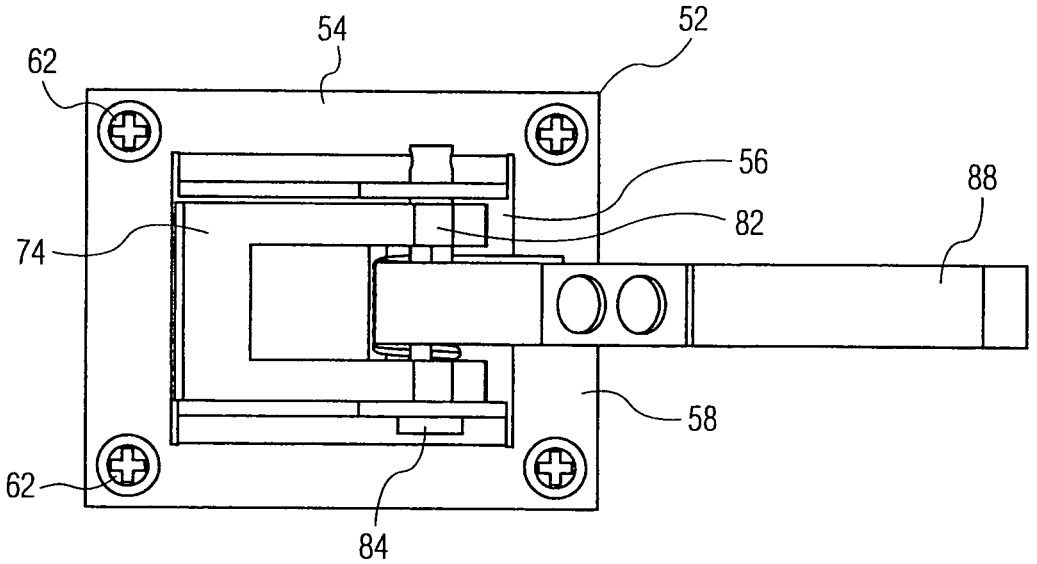
FIG. 10 is a top plan view of an embodiment of the locking mechanism of the tank retaining bracket of the present invention.
Figure 11:
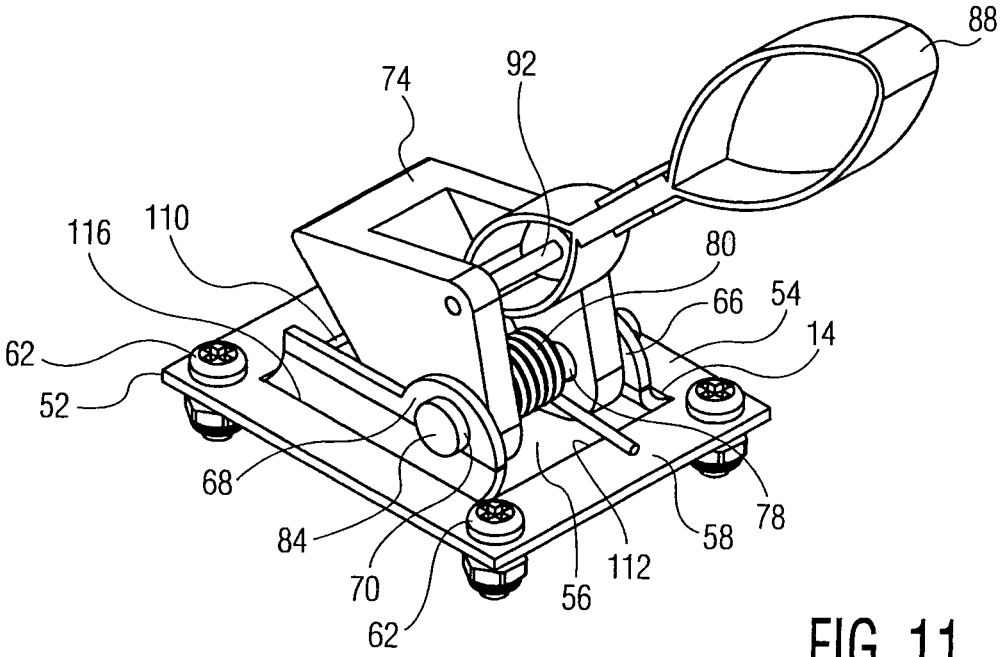
FIG. 11 is an upper perspective view of the embodiment for the locking mechanism shown in FIG. 10.
Figure 12:
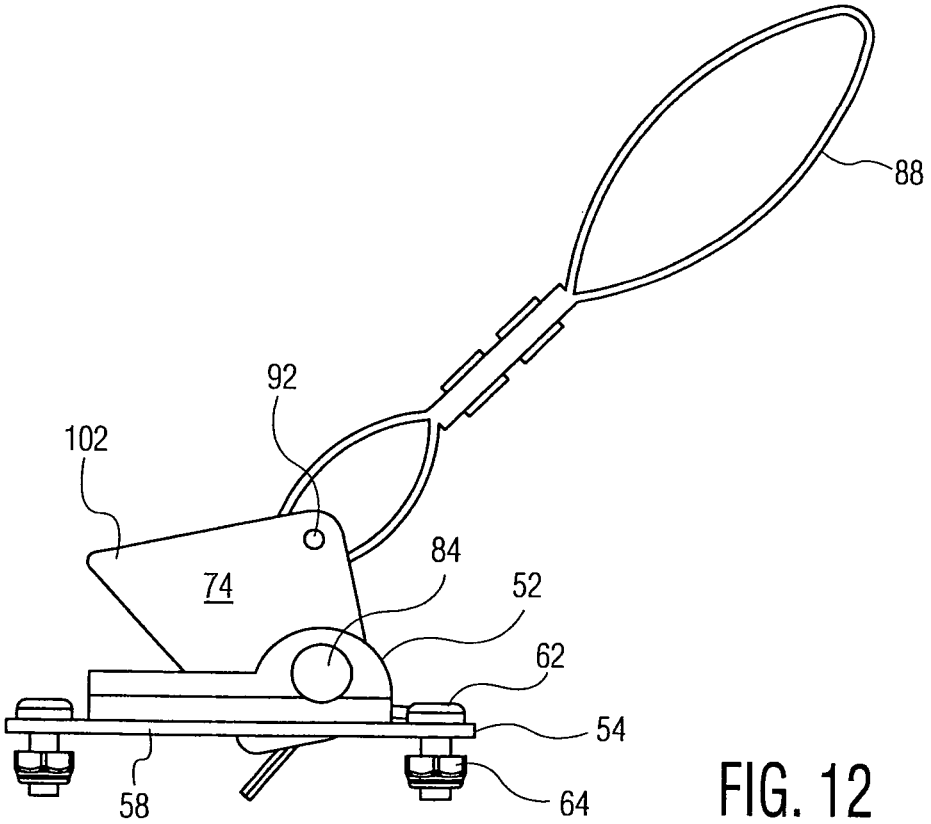
FIG. 12 is a side plan view of the embodiment shown in FIG. 10.
Figure 13:
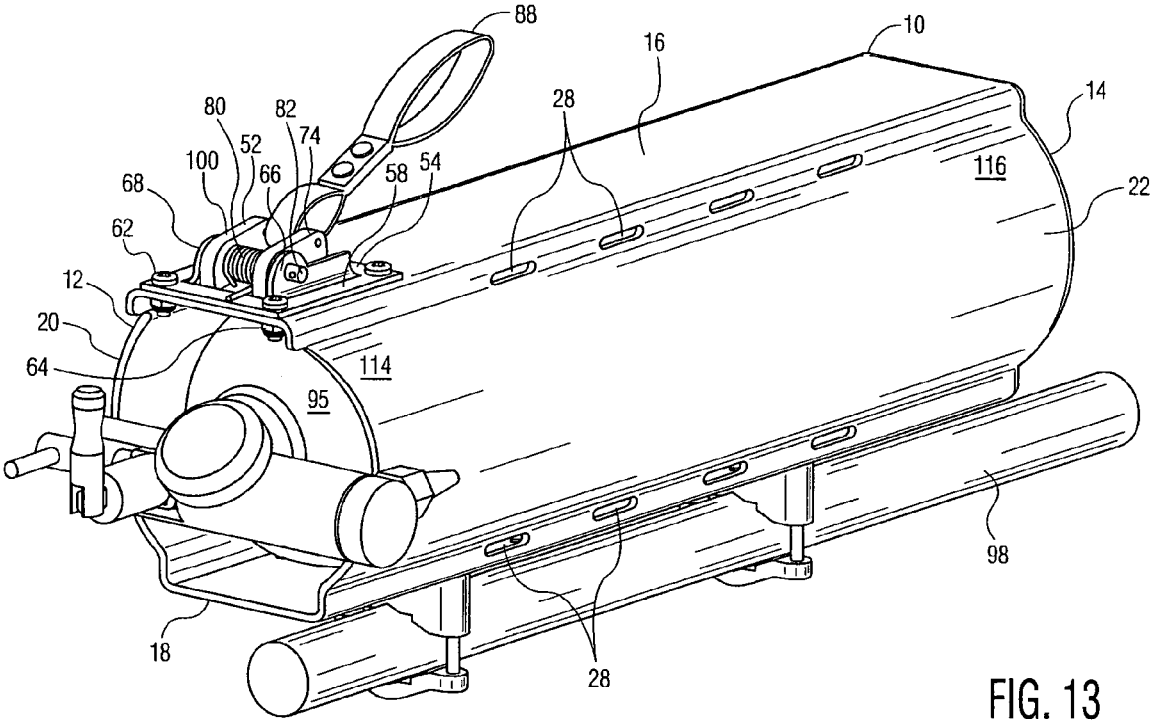
FIG. 13 is a three-quarter perspective view of an embodiment of the tank retaining bracket of the present invention with a tank shown retained therewithin showing adapters positioned in the mounting bracket for facilitating securement with respect to the support construction of a stretcher which has a round cross-sectional profile.
Figure 14:
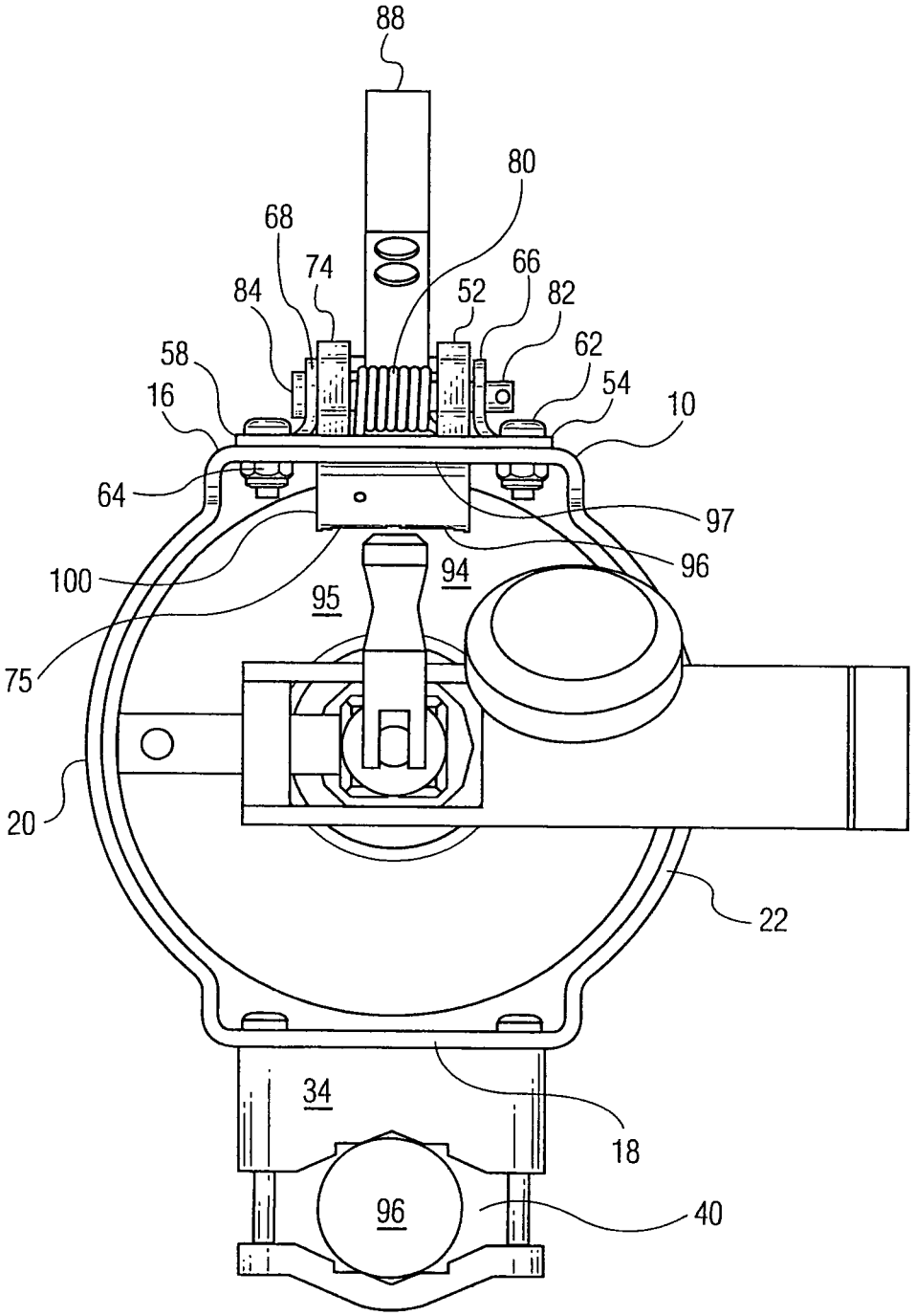
FIG. 14 is a front plan view of the embodiment of the tank retaining means of the present invention shown in FIG. 13.
Figure 15:
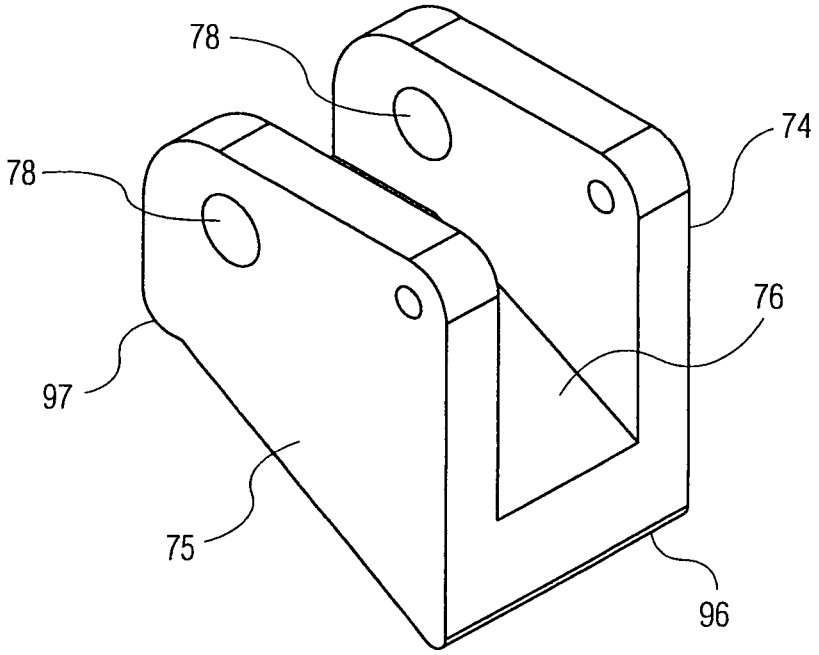
FIG. 15 is a perspective illustration from above of an embodiment of a pivot member for use in the tank retaining bracket of the present invention clearly showing the pivot member slot and the pivot channel means.
Figure 16:
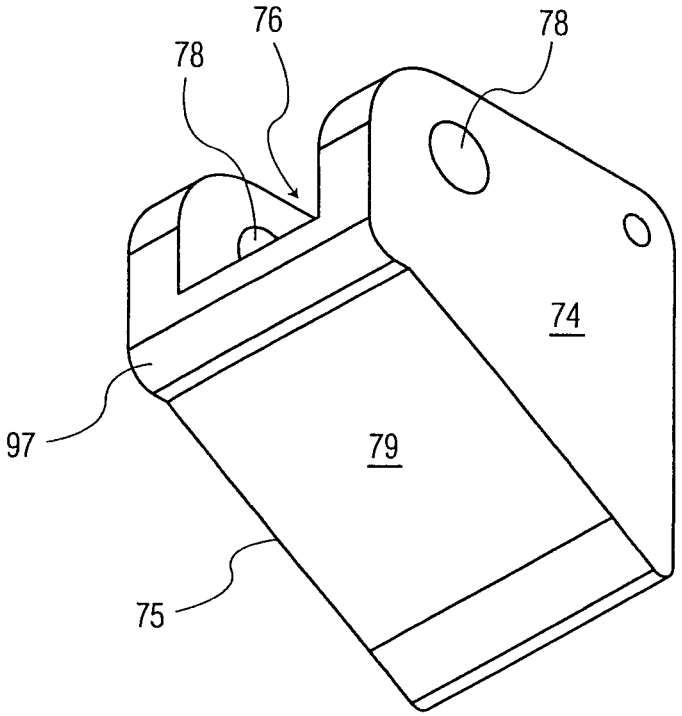
FIG. 16 is a perspective illustration on an embodiment of a pivot member for use in the tank retaining bracket of the present invention clearly showing the pivot member protruding section and the pivot member tank abutment surface.

The present invention provides a tank retaining bracket which includes a housing 10 which is generally at least partially cylindrical in overall shape and which defines an access opening 12 defined in one end thereof. The opposite end of housing 10 is usually at least partially closed by an end panel 14. Four individual housing walls are preferably includes in the overall configuration of housing 10.

The housing walls specifically include, preferably, a first housing wall 16, the second housing wall 18, the third housing wall 20 and the fourth housing wall 22. Housing 10 preferably includes these four walls 16, 18, 20 and 22 oriented extending parallel with respect to each other. Housing 10 also defines an interior chamber means 24 which is in fluid flow communication with respect to the access opening 12. Access opening 12 provides access to this interior chamber means 24 defined within the housing 10 to facilitate positioning of a tank 94 therewithin.

Preferably the housing defines a plurality of housing aperture means therein. These housing aperture means can preferably or alternatively include an end hole 30 positioned within the generally central portion of the end panel 14 as well as a plurality of longitudinal slot means 28 defined at various locations by the housing walls. These longitudinal slot means 28 can provide a means for facilitating securement of the housing 10 of the gas retaining means of the present invention with respect to environment structure in various positions and orientations. In this manner a gas tank or canister 94 can be secured conveniently in a readily accessible position with respect to a gurney or stretcher. Housing 10 also preferably defines a locking opening 32 in at least one of the walls 16, 18, 20 or 22 thereof into which a locking mechanism 52 may be positioned to facilitate locking of a gas canister or tank 94 within the interior chamber 24 of housing 10 thereof as desired. Preferably locking hole 32 will be defined in the first housing wall 16 adjacent said access opening 12. A mounting means 34 is also preferably included for facilitating mounting of the housing 10 of the gas tank retaining means with respect to environmental structure. One form of mounting means could be a strap extending through one or more of the longitudinal slots 28 defined in the housing 10. Such a strap can also be positioned extending around any conveniently available environmental structure to facilitate mounting of the mounting means 34 of the present invention as desired. Housing aperture means 26 such as end holes 30 or longitudinal slot means 28 can also be included in order to provide ventilation and/or cooling if needed in a particular application.

The preferred configuration the present invention includes a mounting means 34 which is designed to be securable with respect to various available portions of emergency transport equipment such as a stretcher or gurney 98. The mounting means 34 preferably includes a first mounting bracket 36 and a second mounting bracket 38 which can be secured to the stretcher 98 at two different positions for maintaining of the housing 10 securely with respect thereto such as to provide a rigidly retained means for holding a tank 94 securely with respect thereto preferably while in any position or, particularly, while extending in a generally horizontal direction as shown in FIG. 1.

The first mounting bracket 36 will preferably include a first mounting bracket aperture 40 which is generally square or rectangular in cross-section and which can be clamped about a portion of the structure of a stretcher 98. Similarly, the second mounting bracket 38 will define a second mounting bracket aperture 42 which is generally square or rectangular which aperture is defined to grasp around a portion of the structure of the stretcher 98. Alternatively, whenever the portion of the stretcher 98 which needs to be secured with respect thereto is of round cross section, a first mounting bracket insert can be positioned within the first mounting bracket aperture 40 and a second mounting bracket insert 46 can be positioned within the second mounting bracket aperture 42 to thereby be securable with respect to a generally round portion of the structure or gurney 98 and, in this manner, provide more universal capabilities for mounting of the gas tank retaining means of the present invention. In this manner securement with respect to a generally arcuate or rounded portion of the structure of a stretcher 98 is made possible along with the capability for securement to a square-shaped section of a stretcher 98.

One of the most important aspects of the present invention is the unique construction of the locking mechanism 52. The locking mechanism 52 will include a locking frame 54 which defines a locking frame aperture 56 extending therethrough. The locking frame aperture 56 is surrounded by a frame mounting rim 58. This mounting rim 58 will include a plurality of frame mounting rim apertures 60 positioned therewithin to secure the frame mounting rim 58 of the locking mechanism 52 with respect to the housing 10. A plurality of frame mounting screws 62 will be included which are mated with frame mounting nuts 64. As such, positioning of the frame mounting screws 62 through a portion of the housing 10 will facilitate securement with respect thereto. In detail, the individual frame mounting screws 62 will extend through the frame mounting rim aperture 60 and through a mated opening in the housing 10. Thereafter each of the frame mounting screws 62 so positioned will include a frame mounting nut 64 attached to the inner end thereof thereby fixedly securing of the locking frame 54 of the locking mechanism 52 with respect to the housing 10 at a position with the locking mechanism 52 extending through the locking opening 32 defined in housing 10.

The frame of the locking mechanism 52 will include a first locking ear 66 and a second locking ear 68 spatially disposed apart from one another on opposite sides of the locking frame aperture 56 as best shown in FIGS. 1,5,10,11 and 12. The first locking ear 66 will include a first locking ear aperture 70 defined therein and second locking ear 68 will define a second locking ear aperture 72 extending therethrough. The first locking ear aperture 66 and the second locking ear aperture 68 will be axially aligned or registered with respect to one another and be adapted to receive a pivot axle 82 extending therethrough to provide an axis about which a pivot member 74 can rotate.

Pivot member 74 will be positioned within the locking frame aperture 56 of the locking frame 54 and will be pivotally movable between a locked position 100 and an unlocked position 102. Pivot member 74 preferably defines a pivot member slot 76 extending therethrough to receive a resilient biasing means 80 such as a locking spring. Pivot member 74 also defines a pivot channel means 78 extending completely therethrough which is adapted to receive said pivot axle 82 extending therethrough to facilitate pivotal movement of said pivot member 74 between the unlocked position 100 and the locked position 102. The pivot axle 82 will preferably be positioned extending through the pivot channel means 78 and also through the first locking ear aperture 70 and the second locking ear aperture 72 in order to provide an axis about which the pivot member 74 is capable of pivoting between the locked position 100 and the unlocked position 102, respectively.

Preferably a pivot channel means 78 will be defined in the pivot member 74 with the pivot axle 82 extending therethrough to facilitate pivotal movement thereof. A resilient biasing means 80 such as a lock or coil spring or the like will be preferably positioned within the pivot member slot 76. By positioning of the lock spring 80 within the pivot member slot in position extending around the pivot axle 82, the resilient biasing means 80 will adapted to continuously urge the pivot member 74 toward the locked position. In the locked position a pivot member protruding section 75 defined on pivotal member 74 will protrude inwardly into the interior chamber means 24 to cause the pivot member 74 to extend inwardly to lock the gas canister 94 in place therewithin. The pivot member protruding section 75 of pivot member 74 will also define a pivot member tank abutment surface 79 thereon which is generally planar and is adapted to abut a tank as it passes into or out of said interior chamber means 24. Pivot member abutment surface 75 is adapted abut a tank 94 as it moves through access opening 12 for placement thereof within said interior chamber means 24. As the tank 94 moves into the bracket it will contact pivot member abutment surface causing the pivot member 74 to move and pivot toward the locked position 100.

The construction of the pivot axle 82 will preferably include a pivot axle head 84 at one end thereof and a hole through the opposite end such that a pivot axle cotter pin or other similar clamping device can extend therethrough for maintaining the pivot axle 82 in position. When positioned properly pivot axle 82 will be extending through the first locking ear aperture 70 and through the pivot channel means 78 and through the pivot slot 76 in the pivot member 74 into the pivot member slot 76 and finally through the second locking ear aperture 72 and outwardly therefrom after which point the cotter pin is attached. The resilient biasing means 80 will be positioned preferably around pivot axle 80 as it extends through pivot member slot 76 to continuously urge movement of pivot member toward the locking position. In this manner firm mounting of the pivot member 74 is achieved while pivotal movement thereof between the locked position 100 and the unlocked position 102 is achievable. It must be understood, however, that the resilient biasing means 80 will establish the steady state position of the pivot member 74 to be continuously forcibly urged toward the locked positioned 100.

To facilitate movement of the pivot member 74 to the unlocked position manually, a handle 88 such as a releasing lanyard will be movably attached with respect to the pivot member 74. Preferably a lanyard pin 92 will extend through the pivot member slot with the handle 88 movably and securely attached to the lanyard pin 92. In this manner the exertion of force manually on the handle or releasing lanyard 88 will exert sufficient power to overcome the force of the locking spring 80 and, thus, will cause the pivot member 74 to pivot to the unlocked position 102.

It is important that the extent of movement of the pivot member 74 toward the unlock position 100 be specifically defined and be limited which is achieved by the defining of a pivot member locking abutment section 96 thereon which will abut the rear section frame mounting rim 58 to limit the extent of movement responsive to the steady state locking force.

In the preferred configuration of the pivot member 74 will be configured such that it allows the gas canister to be automatically locked in place merely by the insertion of the canister completely inwardly within the chamber 24. As the canister is urged inwardly initially through the access opening 12 the outside surface of the canister will contact the outwardly facing inclined surface of the pivot member 74. In this manner pivot member 74 will be urged by the force exerted thereon by the exterior wall of the canister 94 to move toward the unlocked position and allow insertion of the canister completely to a position for retaining thereof defined within the interior chamber 24. Once the canister 94 moves to a position beyond the location of the locking mechanism 52 the pivot member 74 will move inwardly to return to the locking position 100 extending into the interior chamber means 24.

Additionally, most of the gas canisters 94 used with the present invention will include a reduced diameter neck portion 95. This reduced diameter neck portion will be movable along with the tank 94 to a position adjacent and perhaps beyond the location of the locking mechanism 52 responsive to positioning of the canister to the completely inserted position within the interior chamber 24. The reduced diameter neck portion 95 will then allow the pivot member 74 to initiate pivoting toward the locked position 100 and in this manner provide a means for automatically retaining of the canister 94 within the housing 10 without requiring the user to pull on the releasing lanyard 88. Thereafter, if it is desired to remove the canister 94 from the housing 10, manual force needs to be exerted upon the releasing lanyard 88 to overcome the continuous bias exerted by resilient biasing means 80 which tends to urge movement of pivot member 74 toward the locked position 100 in order to allow tank 94 to exit from the interior chamber 24 past the position of locking mechanism 52.

In the preferred configuration of the present invention the housing 10 will define a housing axis 118 extending longitudinally therethrough from access opening 12 axially through said interior chamber means 24 adjacent said first housing end 114 toward the second housing end 116 and terminating at the end panel 14 thereadjacent. In this manner the housing axis 118 will extend generally down the axial middle of the interior chamber means 24 in a longitudinal direction.

An important characteristic of the present invention is in the configuration of the pivot member 74. Pivot member 74 will define a pivot channel means 78 extending therethrough which is in aligning registration with respect to the first locking ear aperture 70 and the second locking ear aperture 72 in such a manner as to be adapted to receive the pivot axle 82 positioned extending therethrough responsive to positioning simultaneously through the first locking ear aperture 70 and the second locking ear aperture 72.

Pivot member 74 is also configured in such a manner as to define a pivot member slot 76 therein in full fluid flow communication with respect to the pivot channel means 78.

The pivot member 74 will also preferably be pivotally movable about the pivot axle 82 between a locked position 100 and an unlocked position 102. In the locked position 100 the pivot member 74 will be adapted to extend into the interior chamber means 24 and in the unlocked position 102 pivot member 74 will be removed therefrom. Preferably pivot member 74 will include a pivot member protruding second 75 which is movable through the locking frame aperture 56 in order to extend into the interior chamber means 24 for locking a tank 94 in the interior chamber means 24 responsive to movement of the pivot member 74 to locked position 100. The pivot member protruding section 75 also is movable to a position removed from and exterior with respect to the interior chamber means 24 responsive to movement of the pivot member 74 to the unlocked position 102 to facilitate movement of a tank 94 through the access opening 12 for placement and removal with respect to the interior chamber means 24.

In the preferred configuration of the present invention the resilient biasing means 80 will comprise a coil spring which is positioned extending around the pivot axle 82 within the pivot chamber means 78 and within the pivot member slot 76.

The configuration of the pivot member 74 will be such that the pivot member protruding section 75 defines the pivot abutment surface 79 which is adapted to abut a tank 94 passing through the access opening 12 during movement of the tank 94 into the interior chamber means 24. Preferably the pivot member abutment surface 79 will be generally planar.

The configuration of the frame mounting rim 58 is important because of the interaction thereof with respect to the pivot member 74 of locking mechanism 52. In particular, the frame mounting rim 58 will preferably define a front section 112 thereof and a rear section 110 thereof. Frame mounting rim 58 will also define a first side section 120 of rim 58 and a second side section 122 of rim 58. First side section 120 will extend between the rear section 110 and the front section 112 of frame mounting rim 58 and the second side section 122 will also extend between the rear section 110 and the front section 112 but at a position spatially disposed from the location of the first side section 120. In this manner the rear section 110, front section 112, first side section 120 and second side section 122 of the frame mounting rim 58 will define the locking frame aperture 56 extending therethrough.

The interaction between the pivot member 74 and the frame mounting rim 58 is an important characteristic of the present invention. In particular, the pivot member 74 includes a pivot member protruding section 75 which includes a pivot member locking abutment section 97 which is movable into abutment with respect to the front section 112 of frame mounting rim 58 responsive to movement of pivot member 74 to the locked position 100 in order to prevent pivoting of the pivot member 74 beyond the proper position for locking responsive to force exerted by the resilient biasing means 80 on the pivot member.

Furthermore the pivot member protruding section 75 will include a pivot member unlocking abutment section 96 which is movable into abutment with respect to the rear section 110 of the frame mounting rim 58 responsive to movement of the pivot member 74 to the unlocked position 110 in order to prevent pivoting of the pivot member 74 beyond this unlocked position responsive to force exerted by manual force being exerted on the handle to overcome the force exerted by the resilient biasing means 80 on the pivot member 74. Furthermore, it is preferable that the pivot member locking abutment section 97 be positioned adjacent to the pivot member tank abutment surface 79 extending outwardly therefrom. It is further important that the pivot member unlocking abutment section 96 be positioned adjacent to the pivot member tank abutment surface 79 and extending outwardly therefrom at a position spatially disposed from the pivot member locking abutment section 97. It is further preferable that the pivot member tank abutment surface 79 be positioned between the pivot member unlocking abutment section 96 and the pivot member locking abutment section 97.

Furthermore the present invention should preferably include a lanyard pin 92 mounted in the pivot member 74 at a position extending through the pivot member slot 76 wherein the handle 88 such as a lanyard can be movably attached to the lanyard pin 92 by extending therearound preferably to facilitate manually powering movement of the pivot member 74 toward the unlocked position 102.

In the preferred configuration of the present invention the pivot member 74 will preferably define the pivot member slot 76 oriented extending therethrough in a direction extending approximately parallel with respect to the housing axis 118 to facilitate pivotal movement of the pivot member 74 between the locked position 100 and the unlocked position 102. Furthermore the pivot member 74 is preferably configured such that the pivot channel means 78 is oriented extending therethrough in a direction extending perpendicularly with respect to the housing axis 118 and perpendicularly with respect to the pivot member slot 76 to further facilitate pivotal movement of pivot member 74 between the locked position 100 and the unlocked position 102.

The configuration of the frame mounting rim 58 can also be critical to certain preferred aspects of the present invention. In particular, the first side section 120 and the second side section 122 should extending approximately parallel with respect to one another and be spatially disposed from one another with the locking frame aperture 56 positioned therebetween and with said rear section 110 and said front section 112 extending therebetween at spatially distant locations from one another. With this configuration the first locking ear 66 will be fixedly secured to and possibly integral with respect to the first side section 120 and extending outwardly therefrom. Furthermore the second locking ear 68 will preferably be fixedly secured to and possibly integral with respect to the second side section 122 and extending outwardly therefrom in order to facilitate pivotal movement of the pivot member 74 about the pivot axle 82. There are certain preferred structural characteristics for the housing of the present invention and preferably the housing 10 will include a first housing wall 16, a second housing wall 18, a third housing wall 20 and a fourth housing wall 22. First housing wall 16 will preferably be generally planar and second housing wall 18 will preferably attach to the first housing wall 16 and extending outwardly therefrom. Preferably the second housing 18 will preferably be arcuate. The third housing wall 20 will preferably be attached to the first housing wall 16 at a position spatially disposed from the second housing wall 18 and extending outwardly therefrom. Third housing wall 20 will also preferably be arcuate in shape. A fourth housing wall 22 will also preferably be included which is generally planar and it will be positioned such that it generally extends between the second housing wall 18 and the third housing wall 20 and is attached thereto at positions spatially disposed from the position on attachment of the first housing wall 16 thereto. With this configuration it is preferable that the second housing wall 18 and the third housing wall 20 will be concave facing inwardly toward the housing axis 118 to facilitate retaining of a cylindrical tank 94 within the interior chamber means 24.

The housing 10 of the present invention also further preferably includes a plurality of housing apertures 26 therein which primarily will include longitudinal slots 28 but also can include end holes 30 defined in the end panel 14. These holes are for ventilation to allow moisture to exit from the interior chamber 24 during usage.

While particular embodiments of this invention have been shown in the drawings and described above, it will be apparent that many changes may be made in the form, arrangement and positioning of the various elements of the combination. In consideration thereof, it should be understood that preferred embodiments of this invention disclosed herein are intended to be illustrative only and not intended to limit the scope of the invention.

We claim:

1. A tank retaining bracket usable to receive and retain a cylindrical tank therewithin which comprises:

A. a housing comprising:

(1) a plurality of housing walls defining an interior chamber therebetween within said housing to selectively receive and retain a cylindrical tank therewith;

(2) a first housing end defining an access opening therein in full fluid flow communication with respect to said interior chamber and being adapted to allow a cylindrical tank to pass therethrough to facilitate entry and exit thereof with respect to said interior chamber, at least one of said housing walls defining a locking opening therein to facilitate locking of a cylindrical tank when retained within said interior chamber;

(3) a second housing end spatially disposed from said first housing end;

(4) an end wall adjacent to and extending over said second housing end to facilitate abutment thereof with respect to a cylindrical tank when positioned retained within said interior chamber;

(5) a housing axis extending longitudinally through said interior chamber from said access opening adjacent said first housing end to said end wall adjacent said second housing end;

B. a locking mechanism attached to said housing walls of said housing at a position immediately adjacent and extending through said locking opening defined in said housing walls, said locking mechanism comprising:

(1) a locking frame secured to said housing at a position adjacent to and extending around said locking opening, said locking frame defining a locking frame aperture positioned in registration with said locking opening and in full fluid flow communication with respect thereto and with respect to said interior chamber;

(2) a first locking ear extending outwardly from said locking frame at a position immediately adjacent said locking frame aperture defined therein, said first locking ear defining a first locking ear aperture extending therethrough;

(3) a second locking ear extending outwardly from said locking frame at a position immediately adjacent said locking frame aperture defined therein and spatially disposed from said first locking ear, said second locking ear defining a second locking ear aperture extending therethrough which is in registration with respect to said first locking ear aperture and spatially disposed therefrom;

(4) a pivot axle positionable extending through said first locking ear aperture and said second locking ear aperture and extending over said locking frame aperture;

(5) a pivot member defining a pivot channel extending therethrough which is in aligning registration with respect to said first locking ear aperture and said second locking ear aperture to be adapted to receive said pivot axle positioned extending therethrough responsive to positioning simultaneously through said first locking ear aperture and said second locking ear aperture, said pivot member also defining a pivot member slot therein in full fluid flow communication with respect to said pivotal channel, said pivot member being pivotally moveable about said pivot axle between a locked position extending into said interior chamber and an unlocked position removed therefrom, said pivot member including a pivot member protruding section which is movable through said locking frame aperture extending into said interior chamber for locking a tank in the interior chamber responsive to movement of said pivot member to the locked position and being pivotally moveable to a position removed from said interior chamber responsive to movement of said pivotal member to the unlocked position to facilitate movement of a tank through said access opening for placement and removal with respect to said interior chamber;

(6) a resilient biasing means positioned within said pivot member slot and attached extending between said pivot member and housing to exert force between said housing and said pivot member for continuously urging thereof toward said locked position thereof; and (7) a handle attached to said pivot member to facilitate manual movement thereof toward said unlocked position by overcoming the force exerted by said resilient biasing means urging said pivot member toward the locked position.

2. A tank retaining bracket usable to receive and retain a cylindrical tank therewithin as defined in claim 1 wherein said resilient biasing means comprises a coil spring positioned extending around said pivot axle within said pivot channel and within said pivot member slot.

3. A tank retaining bracket usable to receive and retain a cylindrical tank therewithin as defined in claim 1 wherein said pivot member protruding section includes a pivot member abutment surface adapted to abut a tank passing through said access opening during movement of a tank into said interior chamber.

4. A tank retaining bracket usable to receive and retain a cylindrical tank therewithin as defined in claim 3 wherein said pivot member abutment surface is generally planar.

5. A tank retaining bracket usable to receive and retain a cylindrical tank therewithin as defined in claim 4 wherein said frame mounting rim will include a front section positioned adjacent said access opening and a rear section more spatially distant from said access opening.

6. A tank retaining bracket usable to receive and retain a cylindrical tank therewithin as defined in claim 5 wherein said pivot member protruding section includes a pivot member locking abutment section which is movable into abutment with respect to said front section of said frame mounting rim responsive to movement of said pivot member to the locked position in order to prevent pivoting of said pivot member beyond the locked position responsive to force exerted by said resilient biasing means on said pivot member.

7. A tank retaining bracket usable to receive and retain a cylindrical tank therewithin as defined in claim 6 wherein said pivot member protruding section includes a pivot member unlocking abutment section which is movable into abutment with respect to said rear section of said frame mounting rim responsive to movement of said pivot member to the unlocked position in order to prevent pivoting of said pivot member beyond the unlocked position responsive to force exerted by manual force exerted on said handle to overcome the force exerted by said resilient biasing means on said pivot member.

8. A tank retaining bracket usable to receive and retain a cylindrical tank therewithin as defined in claim 7 wherein said pivot member locking abutment section is positioned adjacent said pivot member tank abutment surface and extends outwardly therefrom.

9. A tank retaining bracket usable to receive and retain a cylindrical tank therewithin as defined in claim 8 wherein said pivot member unlocking abutment section is positioned adjacent said pivot member tank abutment surface extends outwardly therefrom at a position spatially disposed from said pivot member locking abutment section.

10. A tank retaining bracket usable to receive and retain a cylindrical tank therewithin as defined in claim 1 wherein said pivot member tank abutment surface is positioned between said pivot member unlocking abutment section and said pivot member locking abutment section.

11. A tank retaining bracket usable to receive and retain a cylindrical tank therewithin as defined in claim 1 further comprising a lanyard pin mounted in said pivot member at a position extending through said pivot member slot and wherein said handle is movably attached to said lanyard pin to facilitate manually powering of movement of said pivot member toward the unlocked position.

12. A tank retaining bracket usable to receive and retain a cylindrical tank therewithin as defined in claim 11 wherein said handle comprises a lanyard.

13. A tank retaining bracket usable to receive and retain a cylindrical tank therewithin as defined in claim 1 wherein said pivot member slot is oriented extending through said pivot member in a direction extending parallel with respect to said housing axis to facilitate pivotal movement of said locking member between the locked position and the unlocked position.

14. A tank retaining bracket usable to receive and retain a cylindrical tank therewithin as defined in claim 13 wherein said pivot channel is oriented extending through said pivot member in a direction extending perpendicular with respect to said housing axis and perpendicularly with respect to said pivot member slot to further facilitate pivotal movement of said locking member between the locked position and the unlocked position.

15. A tank retaining bracket usable to receive and retain a cylindrical tank therewithin as defined in claim 5 wherein said frame mounting rim further includes a first side section positioned adjacent said access opening extending between said front section and said rear section and further including a second side section positioned adjacent said access opening extending between said front section and said rear section at a position spatially distant from said first side section.

16. A tank retaining bracket usable to receive and retain a cylindrical tank therewithin as defined in claim 15 wherein said first locking ear is fixedly secured to said first side section and extends outwardly therefrom and wherein said second locking ear is fixedly secured to said second side section and extends outwardly therefrom in order to facilitate pivotal movement of said pivot member about said pivot axle.

17. A tank retaining bracket usable to receive and retain a cylindrical tank therewithin as defined in claim 1 wherein said housing includes:

A. a first housing wall being generally planar;

B. a second housing wall attached to said first housing wall and extending outwardly therefrom, said second housing wall being generally arcuate;

C. a third housing wall attached to said first housing wall at a position spatially disposed from said second housing wall and extending outwardly therefrom, said third housing wall being generally arcuate; and D. a fourth housing wall being generally planar and extending between said second housing wall and said third housing wall and attached thereto at positions spatially disposed from said first housing wall.

18. A tank retaining bracket usable to receive and retain a cylindrical tank therewithin as defined in claim 17 wherein said second housing wall and said third housing wall are concave facing inwardly toward said housing axis to facilitate retaining of a cylindrical tank within said interior chamber.

19. A tank retaining bracket usable to receive and retain a cylindrical tank therewithin as defined in claim 17 wherein said locking opening is defined in said first housing wall adjacent said access opening and spatially distant from said end wall.

20. A tank retaining bracket usable to receive and retain a cylindrical tank therewithin as defined in claim 1 wherein said housing defines a plurality of housing apertures therein to facilitate ventilation of said interior chamber and to facilitate securement thereof with respect to environmental structure.

* * * * *